US006100459A

United States Patent [19]

Yost

[11] Patent Number: 6,100,459

[45] **Date of Patent: *Aug. 8, 2000**

[54] TREMOLO AND/OR VIBRATO CONTROL SYSTEM, AND METHODS OF CONSTRUCTING AND UTILIZING SAME

[76] Inventor: John A. Yost, P.O. Box 91, 8888 Jordan Rd., Cleves, Ohio 45002

[ * ] Notice: This patent is subject to a terminal disclaimer.

[21] Appl. No.: 09/014,021

[22] Filed: Jan. 27, 1998

Related U.S. Application Data

[63] Continuation-in-part of application No. 08/569,569, Dec. 8, 1997, Pat. No. 5,824,925.

[60] Provisional application No. 60/036,487, Jan. 27, 1997.

[51] Int. Cl.[7] ..... G10D 3/00

[52] U.S. Cl. ..... 84/313; 84/312 R; 84/298

[58] Field of Search ..... 84/313, 312 R, 84/298, 307

[56] References Cited

U.S. PATENT DOCUMENTS

| | | | |
|---|---|---|---|
| 1,750,325 | 3/1930 | Mills | 84/11 |
| 2,136,627 | 11/1938 | Lohman | 84/313 |
| 2,949,806 | 8/1960 | Turman | 84/297 R |
| 2,972,923 | 2/1961 | Fender | 84/313 |
| 3,382,749 | 5/1968 | Watson | 84/313 |
| 3,512,443 | 5/1970 | Parson | 84/313 |
| 3,580,124 | 5/1971 | Mancini | 84/313 |
| 4,171,661 | 10/1979 | Rose | 84/313 |
| 4,343,220 | 8/1982 | Lundquist | 84/313 |
| 4,497,236 | 2/1985 | Rose | 84/298 |
| 4,512,232 | 4/1985 | Schaller | 84/313 |
| 4,643,070 | 2/1987 | Petrillo | 84/313 |
| 4,686,883 | 8/1987 | Piche | 84/313 |
| 4,724,737 | 2/1988 | Fender | 84/313 |
| 4,903,568 | 2/1990 | Itoh | 84/313 |
| 4,928,564 | 5/1990 | Borisoff | 84/313 |
| 4,939,971 | 7/1990 | Satoh | 84/313 |
| 4,941,384 | 7/1990 | Jäger | 84/313 |
| 4,944,208 | 7/1990 | Kusek | 84/313 |
| 5,196,641 | 3/1993 | Schaller | 84/740 |
| 5,277,094 | 1/1994 | Spuler | 84/298 |
| 5,311,804 | 5/1994 | Wilkinson | 84/313 |
| 5,392,680 | 2/1995 | Stets | 84/313 |
| 5,438,902 | 8/1995 | Baker | 84/312 R |
| 5,824,925 | 10/1998 | Yost | 84/313 |

FOREIGN PATENT DOCUMENTS

| | | |
|---|---|---|
| 20777363 | 3/1994 | Canada . |
| 3520843 | 12/1986 | Germany . |
| 61679686 | 6/1994 | Japan . |
| 905447 | 9/1962 | United Kingdom . |

OTHER PUBLICATIONS

*Electric Guitar Setups* by Hideo Kakimoto, © 1994 Amsco Publications, New York NY, pp. 22–24, 55–60, 62–65.

*Guitar Shop* (magazine), Sep. 1997, column: "Great Tremolo Setups" by Roger Sadowsky, p. 78.

*Stewart—Macdonald's Guitar Shop Supply* (catalogue), Summer 1997, p. 71.

*Primary Examiner*—Stanley J. Witkowski
*Assistant Examiner*—Shih-yung Hsieh
*Attorney, Agent, or Firm*—Carrier, Blackman & Associates, P.C.; William D. Blackman; Joseph P. Carrier

[57] ABSTRACT

A tremolo system for a stringed musical instrument, comprising a tremolo arm member which extends outwardly from the instrument body and is rotatable about its longitudinal axis; a bridge member which engages with the instrument strings and is capable of pivoting about an axis so as to alter the tension of the instrument strings; and a mechanism for rotating the bridge member about an axis in response to manual rotation of the tremolo arm member, including a cam member which is connected to the tremolo arm member, and a cam follower member which is movable within the instrument body and which is suitably connected to the bridge member.

40 Claims, 7 Drawing Sheets

TREMOLO AND/OR VIBRATO CONTROL SYSTEM, AND METHODS OF CONSTRUCTING AND UTILIZING SAME

This application claims benefit from provisional application 60/036,487, filed Jan. 27, 1997, and is a continuation-in-part of nonprovisional application Ser. No. 08/569,569, filed Dec. 8, 1997, now U.S. Pat. No. 5,824,925. The disclosure of each such application is incorporated herein by reference thereto.

BACKGROUND OF THE INVENTION

1. Field of Invention

This invention pertains to a system for controlling the vibrato effect of a stringed musical instrument, such as a guitar, and in particular to a device which controls the movement of the instrument bridge in response to manipulation of the instrument's tremolo arm.

2. Description of the Relevant Art

There are known tremolo and/or vibrato devices. For example, Itoh U.S. Pat. No. 4,903,568 discloses a tremolo device for a guitar having a stabilizing plate and mounted spring to maintain an initial position of the tremolo arm.

Watson U.S. Pat. No. 3,382,749 discloses a tremolo device utilizing a single rod cylinder to inflate a diaphragm disposed on the guitar body.

Lohman U.S. Pat. No. 2,136,627 discloses a tremolo device for a guitar comprising an electric motor to impart a vibratory motion to the guitar strings.

Kusek U.S. Pat. No. 4,944,208 discloses an adjustable tremolo device for a guitar including a cam for controlling the operation of the individual strings.

Borisoff U.S. Pat. No. 4,928,564 discloses a tremolo stabilizing unit including springs for providing appropriate biasing.

Fender U.S. Pat. No. 4,724,737 discloses a tremolo unit including a rocker element and a spring for applying a bias.

Satoh U.S. Pat. No. 4,939,971 discloses a tremolo device for a guitar including a spring member to maintain the guitar bridge in an initial position.

The above-identified references, however, fail to disclose a tremolo unit for a stringed instrument having means for isolating the tuning of each string, a means for muting the instrument without affecting the tuning thereof, a means for generating a tremolo effect by rotating the tremolo arm about an axis substantially perpendicular to the instrument face, and/or wherein the pitch of the instrument strings may be both raised and lowered relative to string pitch when the tremolo arm is at rest.

A significant problem associated with prior tremolo systems is that prior systems at most only resist change in tension of all the strings when the tension in one string changes. In such systems, a balanced condition exists wherein the upwardly-directed forces acting on the instrument bridge by the instrument strings are balanced with the downwardly-directed spring forces acting on the bridge. It can easily be seen that a change in string tension in one string will upset this equilibrium between the forces acting on the bridge, resulting in the bridge being displaced and thus changing string pitch in all the strings. Tuning the instrument and maintaining a tuned instrument are quite difficult as a result. In addition, tremolo systems having latching mechanisms for locking the tremolo arm into a fixed position require some manipulation to activate and deactivate the latching mechanism which, during a musical performance, is quite inconvenient to perform.

SUMMARY OF THE INVENTION

The present invention overcomes the above-discussed limitations and shortcomings of known tremolo devices and satisfies a significant need for a tremolo and/or vibrato device for a stringed instrument which provides improved musical performance capabilities.

According to the invention, there is provided a vibrato system for a stringed musical instrument, comprising a tremolo arm member which extends outwardly from the instrument body and is rotatable about its longitudinal axis; a bridge member which engages with the instrument strings and is capable of pivoting about an axis so as to alter the tension of the instrument strings; and a means for rotating the bridge member about an axis in response to manual rotation of the tremolo arm member.

In one preferred embodiment of the present invention, the bridge rotating means comprises a cam member which is connected to the tremolo arm member and a cam follower member which is movable within the instrument body and which is suitably connected to the bridge member.

In use, rotation of the tremolo arm member rotates the cam member so as to displace the cam follower member from its position at rest. The displacement of the cam follower member causes the bridge member to rotate accordingly, thereby altering the tension and pitch of the instrument strings.

It is an object of the present invention to provide a tremolo system for a stringed musical instrument in which a change in pitch and/or tension of one string, such as when tuning or bending a string or when a string breaks, has substantially no effect on the pitch of the remaining strings.

It is another object of the present invention to provide a tremolo system for a stringed instrument that requires no balancing or other manual adjusting in order to account for changes in the particular gauge of the string sets used.

Another object of the present invention is to provide a tremolo system for a stringed musical instrument wherein the user may create a muted effect without affecting the pitch of the instrument strings.

Still another object of the present invention is to provide a tremolo system for a stringed musical instrument wherein a tremolo effect is generated in the conventional manner, i.e., by pushing the tremolo arm downwardly towards the instrument surface or pulling the tremolo arm upwardly from the instrument surface, and wherein the design of the tremolo device may be easily modified so that a tremolo effect may be generated by rotating the tremolo arm along the surface of the instrument.

It is another object of the invention to provide a tremolo system for a stringed musical instrument that requires less physical effort to activate.

Other objects, advantages and salient features of the present invention will become apparent from the following detailed description, which, when taken in conjunction with the annexed drawings, disclose preferred embodiments of the present invention.

DETAILED DESCRIPTION OF THE PREFERRED EMBODIMENTS

Figure 1:
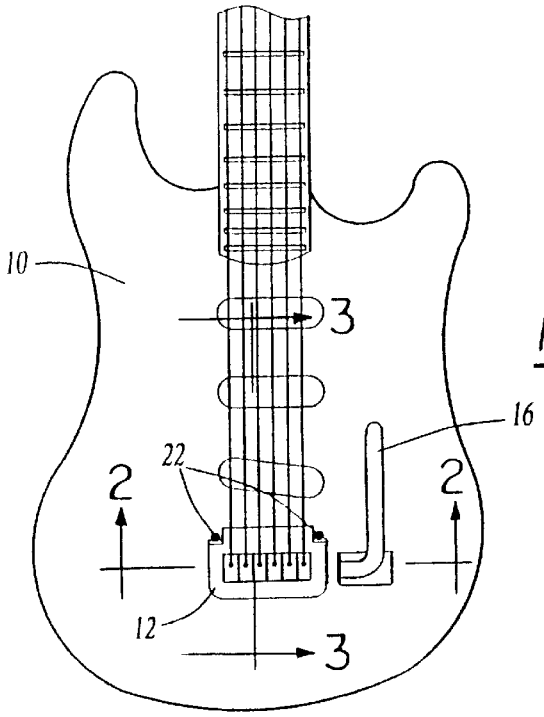
FIG. 1 is a top plan view of a front surface of a stringed instrument according to the preferred embodiments of the present invention.
Figure 2A:
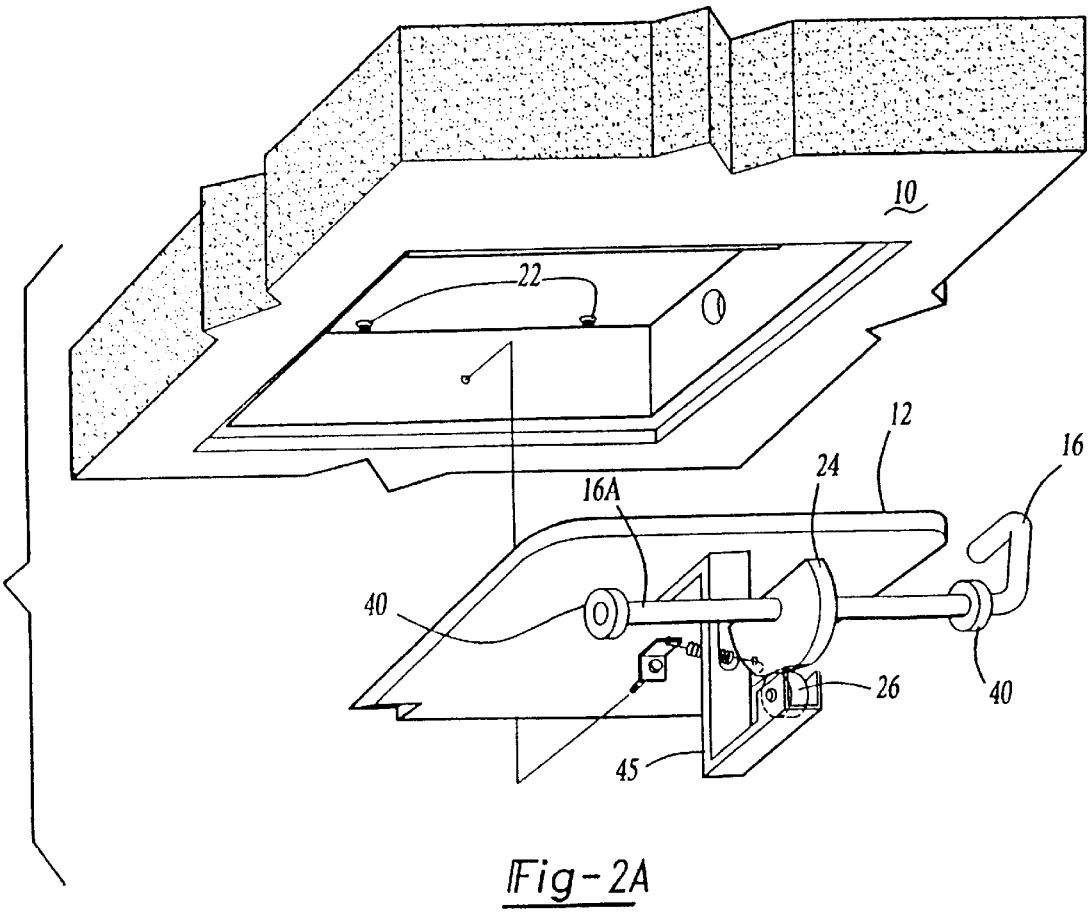
FIG. 2A is an exploded perspective view of a tremolo system according to a first preferred embodiment of the present invention, with a portion of the instrument body shown cut away.
Figure 2B:
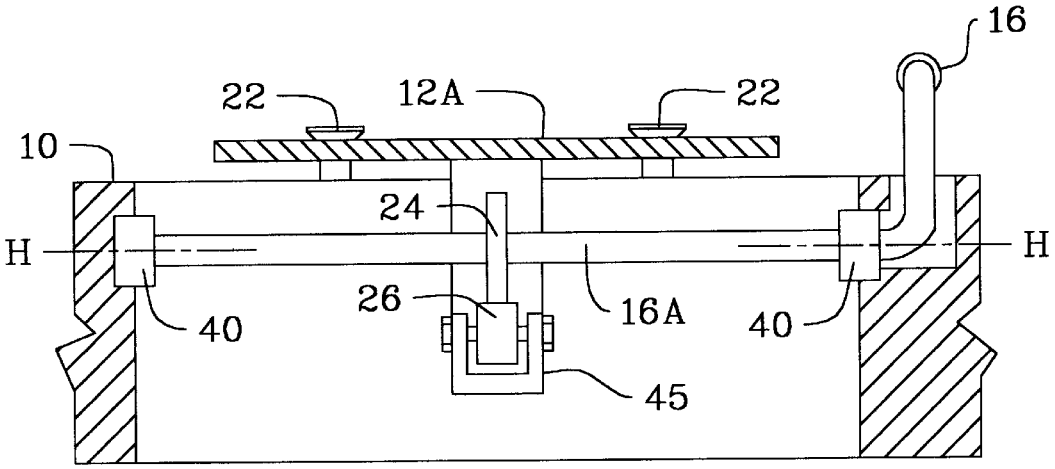
FIG. 2*b* is a side elevational view of a tremolo system according to a first preferred embodiment of the present invention, taken along line 2—2 of FIG. 1.
Figure 3:
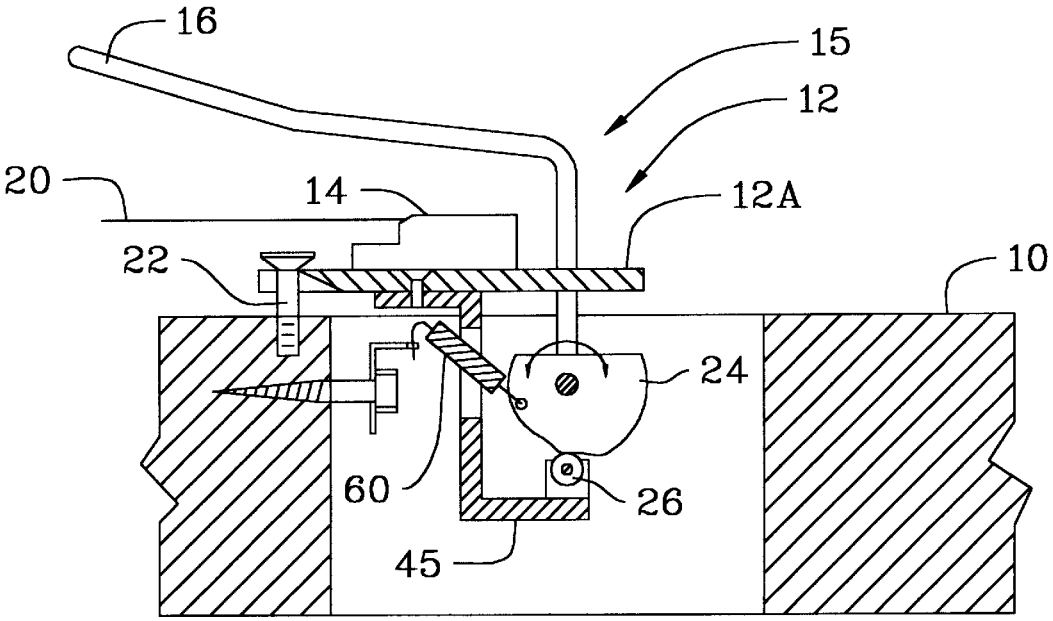
FIG. 3 is a side elevational view of a tremolo system according to a first preferred embodiment of the present invention, taken along line 3—3 of FIG. 1.

Referring to FIGS. 1–3, there is disclosed a vibrato and/or tremolo device according to a first preferred embodiment of the present invention, comprising tremolo arm 16, cam member 24 and a means for engaging an edge of the cam member with instrument bridge 12 so that rotation of tremolo arm 16 induces rotation of bridge 12 about pivot posts 22.

Instrument bridge 12 is engaged with the end portions of strings 20 so as to provide tension thereto, as shown in FIG. 3. Bridge 12 preferably contacts pivot posts 22 (which are mounted to instrument body 10) so that bridge 12 rotates about posts 22, with the tension of strings 20 (and hence their pitch) being dependent upon the amount of rotation of bridge 12. It will be helpful in understanding the disclosure hereof to provide definitions of a stringed instrument bridge, a stringed instrument tailpiece, and a stringed instrument combined bridge/tailpiece assembly.

A stringed instrument bridge is the component over which the instrument strings are stretched. The bridge is engaged with the instrument body and transmits vibrations from the instrument strings to the instrument body.

A tailpiece is the component that secures an end of each of the instrument strings for applying tension thereto, so that the strings may be stretched over the instrument bridge. The tailpiece is the component at which the strings terminate.

When the bridge and tailpiece are separate components, the bridge engages with the strings before the tailpiece, so that the bridge is located closer to the neck of the instrument than the tailpiece, such as on a guitar.

The present invention is being described for exemplary purposes only in association with an instrument in which the instrument tailpiece 14 and/or component at which strings 20 terminate is integrally connected and/or part of bridge 12, i.e., the component which transmits vibrations from strings 20 to body member 10 so that a combined bridge/tailpiece assembly is disclosed, wherein the bridge and tailpiece are combined into a single component assembly, and pivot about the same axis, where the inner edge of the bridge 12 contacts the posts 22. It is understood that the present invention may be used with stringed instruments in which instrument tailpiece 14 is separate from instrument bridge 12.

A first segment 16A of tremolo arm 16 is mounted within instrument body 10 using bearings 40 so that manipulation of the outwardly extending portion of tremolo arm 16 in a conventional manner (i.e., downward towards instrument body 10 or upward and away from body 10) causes tremolo arm segment 16A to rotate about its longitudinal axis H, which may be characterized as a first longitudinal axis.

Cam member 24 is preferably attached to and extends from segment 16A of tremolo arm 16, as shown in FIGS. 2 and 3. The cam member 24 may be characterized as a first rotatable member. Cam member 24 preferably has a varying radius in order to induce movement of bridge 12 upon rotation thereof, thereby raising or lowering string pitch relative to the string pitch when tremolo arm 16 is at rest (i.e., without any tremolo/vibrato effect). For example, in one preferred embodiment, rotating tremolo arm 16 in the clockwise direction causes string pitch to lower relative to string pitch when tremolo arm 16 is at rest, while rotating tremolo arm 16 in the counterclockwise direction causes string pitch to raise relative to string pitch when tremolo arm 16 is at rest. In another preferred embodiment, the radius of cam member 24 is designed so that rotation of tremolo arm 16 in a counterclockwise direction lowers string pitch, while rotation of tremolo arm 16 in a clockwise direction raises string pitch. As a result, users of the musical instrument are provided more options to suit their individual tastes.

The cam engaging means preferably comprises cam follower 26 which engages with the outer edge of cam member 24, and bridge post 45 which extends downwardly from the underside of bridge plate 12A and to which cam follower 26 is rotatably connected. The cam follower 26 may be characterized as a second rotatable member. The cam engaging means, as discussed above, provides a means for moving the instrument bridge 12 in response to movement of the cam member 24.

Cam member 24 preferably has a varying radius resulting in an eccentric outer surface so that the rotation of tremolo arm 16 rotates cam follower 26, bridge post 45 and bridge plate 12A about the points of contact between the bridge 12 and the pivot posts 22. When a portion of cam member 24 having a larger radius contacts cam follower 26, cam follower 26 and bridge plate 12A pivot into instrument body 10, thereby increasing string tension and therefore string pitch; and when the portion of cam member 24 having a smaller radius contacts cam follower 26, cam follower 26 and bridge 12 pivot outwardly of instrument body 10, thereby decreasing string tension and pitch.

Figure 7:
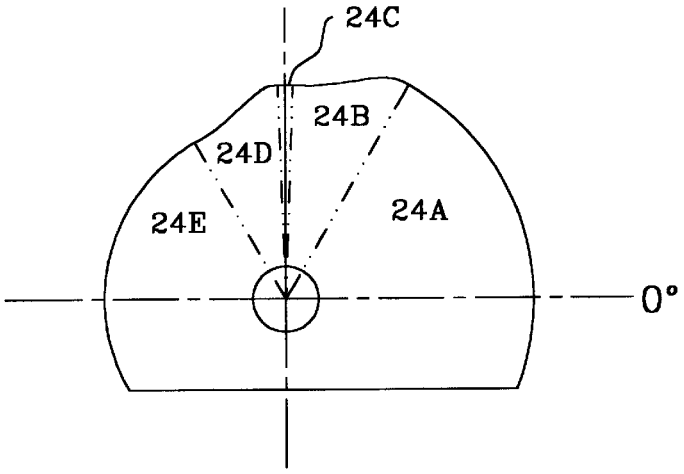
FIG. 7 is a plan view of a cam member according to the first and fourth preferred embodiments of the present invention.

Accordingly, cam member 24 includes a portion 24A having an increased radius and another portion 24E having a decreased radius, relative to the cam radius when tremolo arm 16 is at rest. Referring to FIG. 7, cam member 24 is preferably but not necessarily divided into at least five sections. Alternatively, cam member 24 is divided into a different number of sections.

According to a preferred embodiment of the present invention, a first portion 24A of cam member 24, such as from 0° to approximately 60°, has a substantially constant first radius; a second portion 24B of cam member 24, such as from approximately 60° to approximately 88°, preferably has a first varying radius; a third or resting portion 24C of cam member 24, such as from approximately 88° to approximately 92°, preferably has a second constant radius; a fourth portion 24D of cam member 24, such as from approximately 92° to approximately 120°, preferably has a second varying radius; and a fifth portion 24E of cam member 24, such as from approximately 120° to approximately 180°, preferably has a third constant radius. In this way, rotating tremolo arm 16 so that portion 24A engages with cam follower 26 raises the pitch of strings 20, while rotating tremolo arm 16 so that portion 24E engages with cam follower 26 lowers the pitch of strings 20, relative to string pitch when tremolo arm 16 is at rest.

Resting portion 24C of cam member 24 preferably but not necessarily comprises a dwell of substantially constant radius which contacts cam follower 26 when tremolo arm 16 is at rest, i.e., when it is not being manipulated or otherwise utilized by the user-musician. Thus the instrument is tuned normally while resting cam portion 24C engages with cam follower 26. The design of cam portion 24C is such that the force cam follower 26 exerts on cam portion 24C due to strings 20 pulling bridge 12 upwardly will not cause rotation of cam member 24 in either direction when tremolo arm 16 is at rest. This results in a tremolo system having a non-backdriving mechanism and/or characteristic. As a result of this non-rotational feature, varying the tension of strings 20, such as by tuning strings 20 or otherwise, does not alter the positions of cam follower 26, bridge 12 or tremolo arm 16. This nonmovement of bridge 12 thereby ensures that strings 20 can be independently tuned without the tuning of any string 20 from affecting the tuning of another string 20, and that bridge 12 will be substantially completely stable and immobilized when tremolo arm 16 is at rest.

Cam portions 24B and 24D preferably provide smooth transitions between portions of cam member 24 having different radii. In preferred embodiments of the present invention, the outer edge of cam portions 24B and 24D each comprise a modified sine curve. Alternatively, cam portions 24B and 24D include outer edges forming other shapes which form smooth transitions between cam portions 24A and 24E. By cam member 24 having smooth, gradual transitions between cam portions of differing radii, less force is required to rotate tremolo arm 16. The present invention is being described, for exemplary and illustrative purposes only, in association with a rotatable disk cam, however, it is understood that other cam mechanisms may be used in the present invention in place of cam member 24 in rotating bridge 12 so as to create a vibrato effect. In addition, it is understood that cam member 24 may have another shape so long as cam member 24 is capable of displacing cam follower 26 and bridge plate 12A. For example, cam member 24 may be a cylindrical cam, grooved cam, yoke cam, globular cam, spiral cam or linear cam. It is also understood that cam follower 26 may be attached to tremolo arm 16 so that cam follower 26 is the driving component and cam member 24 is the driven component.

In an alternative embodiment, a plurality of cam members 24 may be attached along tremolo arm section 16A. In this alternative embodiment, a first cam member would include a dwell portion 24C (as described above) with the remaining cam portions having a very small radius; while the second cam member would include the cam portions 24A, 24B, 24D and 24E. As a result, the cam members may be more suitably sized to perform the necessary work with relatively little manual effort.

The first preferred embodiment preferably but not necessarily includes a means for returning tremolo arm 16 to its position at rest when it is no longer subject to manual rotation. Referring to FIG. 3, the return means preferably comprises biasing member 60, having a first end engaged with an edge of cam member 24 and a second end which is engaged with the instrument body 10. In a preferred embodiment of the present invention, biasing member 60 comprises a spring, but alternatively it may suitably comprise other biasing elements. As shown, after cam member 24 has been displaced in either direction due to rotation of tremolo arm 16, biasing member 60 preferably urges cam member 24 in the opposite direction until resting cam portion 24C contacts cam follower 26.

In another preferred embodiment, a plurality of biasing members 60 are used wherein one end of each is connected to opposite ends of cam member 24, such as at 0° and 180°, and a second end of each is connected to instrument body 10. In this embodiment, substantially equal and opposite forces bias cam member 24 so as to position resting cam portion 24C adjacent cam follower 26. The presence of opposing biasing forces substantially eliminates occurrences of over-damping and/or overshooting of cam member 24, i.e. wherein in returning cam member 24 to its position at rest, the biasing force initially urges cam member 24 beyond its position at rest due to the nature and extent of the biasing force. It is understood that biasing members other than return spring 60 may be used in place thereof.

The extent to which pivot posts 22 extend from instrument body 10 is preferably adjustable in order to adjust the distance between strings 20 and the instrument finger board to accommodate user preference and to account for different size strings 20. Consequently, cam follower 26 is adjustable along post 45 in order to provide this adjustability.

In use, rotation of tremolo arm 16 in a first direction causes cam portion 24A to contact cam follower 26 and to urge cam follower 26 and bridge plate 12A along an arcuate path into instrument body 10 as they are pivoted about pivot posts 22. Due to strings 20 being stretched by this pivoting action, string pitch is increased.

Similarly, rotation of tremolo arm 16 in a second direction causes cam portion 24E to be positioned adjacent cam follower 26. Because the radius of cam portion 24E is substantially less than the radius of the other cam portions, positioning cam portion 24E adjacent cam follower 26 allows bridge 12 to pivot upwardly away from instrument body 10 due to forces applied to bridge plate 12A by strings 20 which are now capable of moving cam follower 26 and bridge 12 outwardly away from instrument body 10. This positioning pivots cam follower 26 and bridge plate 12A outwardly away from instrument body 10 due to forces applied to bridge 12 by strings 20. As a result of bridge 12 being pivoted outwardly, string tension and string pitch are lowered relative to string tension and pitch when another portion of cam member 24 is adjacent cam follower 26.

Further, because the tension of strings 20 provide an upward force on bridge 12, cam follower 26 is urged into contact with cam member 24.

It will be understood from the foregoing that the tailpiece 14, the bridge 12, the bridge post 45 and the cam follower 26 are all connected to one another, and move pivotally together as an integral bridge member or bridge/tailpiece assembly 15 with respect to the pivot posts 22. However, the cam 24 is not attached thereto, but rather, is independently mounted to the instrument body 10 via the tremolo arm segment 16A. As a result of the above-described relationship of components, the cam 24 acts as a stop member, limiting pivotal movement of the bridge/tailpiece assembly about the pivot posts 22 in a counterclockwise direction, as viewed in FIG. 3, because the cam 24 is disposed blockingly above the cam follower 26. When tremolo arm 16 is not being manipulated and/or utilized by the user-musician, this contact substantially prevents any movement of bridge 12 or cam follower 26, thereby ensuring that strings 20 can be independently tuned without the tuning of one of strings 20 from affecting the tuning of another. Additionally, bending one of strings 20 will not affect the tension or pitch of the remaining strings 20. Because the balanced condition between instrument strings 20 pulling bridge 12 upwardly and the tremolo springs pulling bridge 12 downwardly has been eliminated with the use of cam member 24, breaking a string 20 will not affect the tension or pitch of the other strings 20. Further, because the upward forces acting on bridge 12 by strings 20 are substantially greater than the downward force a user may apply on bridge 12 to create a muted effect, the stringed instrument may be muted without altering string pitch.

The Second Preferred Embodiment

Figure 4:
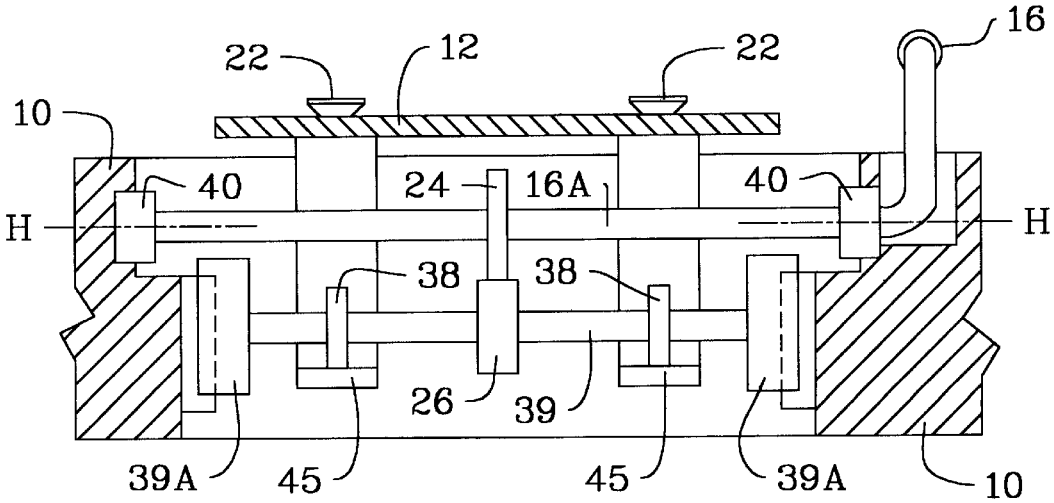
FIG. 4 is a side elevational view of a tremolo system according to a second preferred embodiment of the present invention, taken along line 2—2 of FIG. 1.
Figure 5:
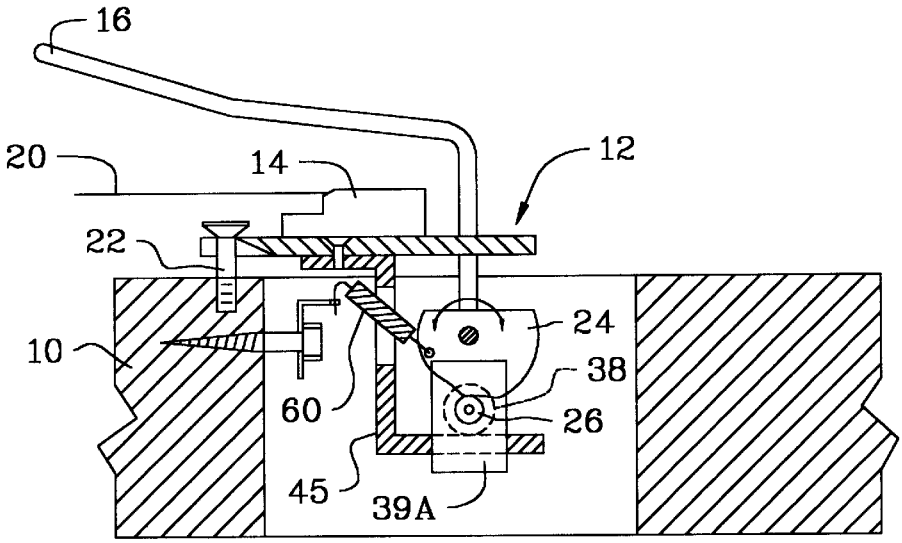
FIG. 5 is a side elevational view of the tremolo system according to a second preferred embodiment of the present invention, taken along line 3—3 of FIG. 1.

Referring to FIGS. 4–5, there is disclosed a second preferred embodiment of the present invention which is a modification of the first preferred embodiment discussed above. Specifically, the second preferred embodiment comprises tremolo arm and/or vibrato arm 16, which is partially disposed within instrument body 10 and having bearings 40 connected thereto so that tremolo arm 16 may be rotated along a first longitudinal axis H; instrument bridge 12; and a means for rotating bridge 12 relative to instrument body 10 in response to manipulation of tremolo arm 16. The rotating means preferably but not necessarily comprises cam member 24 which is connected to tremolo arm 16 along its first longitudinal axis; bridge posts 45 which are attached to bridge 12 and which extend into instrument body 10; bridge rod 39; bearings 38 which are connected to bridge rod 39 and are slidingly engaged with bridge posts 45 so that bridge posts 45 are slidable along bearings 38 as bridge 12 is rotated about pivot posts 22; and bearing and bracket assemblies 39A, which are engaged with bridge rod 39, such as at both ends thereof.

Bridge posts 45 preferably extend downwardly from an unexposed surface of bridge 12 and into instrument body 10. The outer casing of bearings 38 slidingly engage with the end portions of bridge posts 45. In this way, as bridge posts 45 rotate due to rotation of bridge 12 about pivot posts 22, the lower portions of bridge posts 45 slide along the bearings 38 (FIG. 5), thereby allowing bridge rod 39 to translate in a linear direction as guided by bearing/bracket assemblies 39A.

A section 16A of tremolo arm 16 is preferably but not necessarily disposed within instrument body 10, as shown in FIG. 4. Tremolo arm section 16A is connected to bearings 40 which are attached to body 10 so that manipulation of the outwardly extending portion of tremolo arm 16 in a conventional manner (i.e., downward towards instrument body 10 or upward and away from instrument body 10 as shown in FIG. 4) causes tremolo arm section 16A to rotate along its longitudinal axis H.

Figure 6:
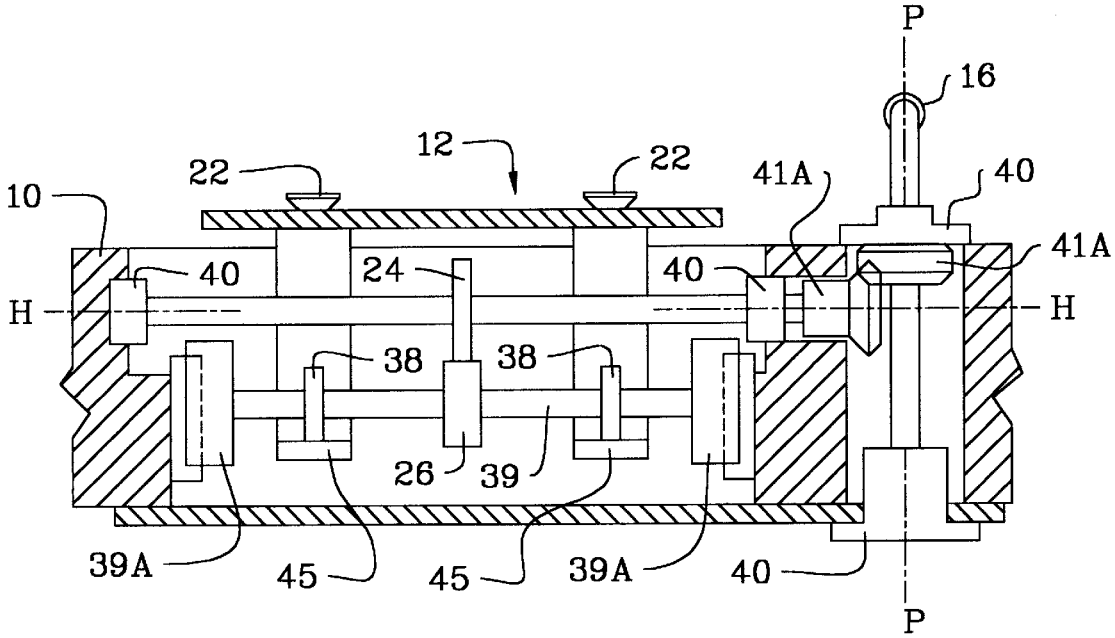
FIG. 6 is a side elevational view of the tremolo system according to a second preferred embodiment of the present invention, taken along line 2—2 of FIG. 1.

The user/musician of the present invention is preferably capable of generating a tremolo effect in part by rotating tremolo arm 16 so that tremolo portion 16A rotates about axis H. Tremolo arm 16, according to the second preferred embodiment of the present invention, may additionally include bevel gearing 41A located at the intersection of the two longitudinal sections of tremolo arm 16 (FIG. 6). In this way, manually rotating tremolo arm section 16B about its longitudinal axis P causes tremolo arm section 16A to rotate about its longitudinal axis H. This operation allows the musician to execute a more natural hand movement when generating a tremolo effect.

Cam member 24 is connected to tremolo arm section 16A and is dimensioned the same as cam member 24 in the first preferred embodiment of the present invention. An outer edge of cam member 24 engages with cam follower 26, which itself is connected to bridge rod 39. Cam member 24 preferably has a varying radius so that the rotation of tremolo arm 16 translates bridge rod 39 in a substantially linear direction as guided by bearing/bracket members 39A, thereby allowing bridge 12 to rotate about pivot posts 22. When the portion of cam member 24 having a larger radius contacts cam follower 26, bridge rod 39 is substantially moved in a direction substantially away from bridge 12 (a substantially downward direction as shown in FIGS. 4 and 5), thereby increasing string pitch; and when the portion of cam member 24 having a smaller radius contacts cam follower 26, bridge rod 39 is substantially moved in a direction substantially towards bridge 12, thereby decreasing string pitch.

Bridge rod 39 preferably slidably engages with bearing/bracket assemblies 39A so that bridge rod 39 is translatable in a linear direction as guided by bearing/bracket assemblies 39A. As shown in FIG. 5, bridge rod 39 engages with bearing/bracket assembly 39A so that bridge rod 39 moves only in a direction which is perpendicular to the instrument face. In the second preferred embodiment of the present invention, bearing/bracket assemblies 39A preferably comprise linear roller slides. Alternatively, cam follower 26 and bridge rod 39 are associated with other mechanisms that form a substantially frictionless engagement therewith and which allow cam follower 26 and bridge rod 39 to translate only in a linear direction.

In use, rotation of tremolo arm 16 in a first direction causes cam portion 24A to contact cam follower 26. Such contact urges bridge rod 39 along bearing/bracket assemblies 39A in a direction which is substantially away from bridge 12, thereby pivoting bridge 12 downwardly and towards instrument body 10 and increasing string pitch.

Similarly, rotation of tremolo arm 16 in a second direction causes cam portion 24E to be positioned adjacent cam follower 26. Because the radius of cam portion 24E is substantially less than the radius of the other cam portions, positioning cam portion 24E adjacent cam follower 26 allows bridge 12 to pivot upwardly away from instrument body 10 due to forces applied to bridge 12 by strings 20 which are now capable of moving bridge rod 39 substantially upwardly towards the face of instrument 10, as shown in FIGS. 4 and 5. As a result of bridge 12 being pivoted upwardly, string pitch is lowered relative to the string pitch when another portion of cam member 24 is adjacent cam follower 26.

Further, because the tension of strings 20 provide an upward force on bridge 12, bridge rod 39 (connected to bridge 12 via bridge posts 45) urges cam follower 26 into contact with cam member 24. When tremolo arm 16 is not being rotated, this contact substantially prevents any movement of bridge 12 or bridge rod 39, thereby ensuring that strings 20 can be independently tuned without the tuning of one of strings 20 from affecting the tuning of another. Because the upward forces acting on bridge 12 by strings 20 are substantially greater than the downward force a user may apply on bridge 12 to create a muted effect, the stringed instrument may be muted without altering string pitch.

The Third Preferred Embodiment

Figure 8:
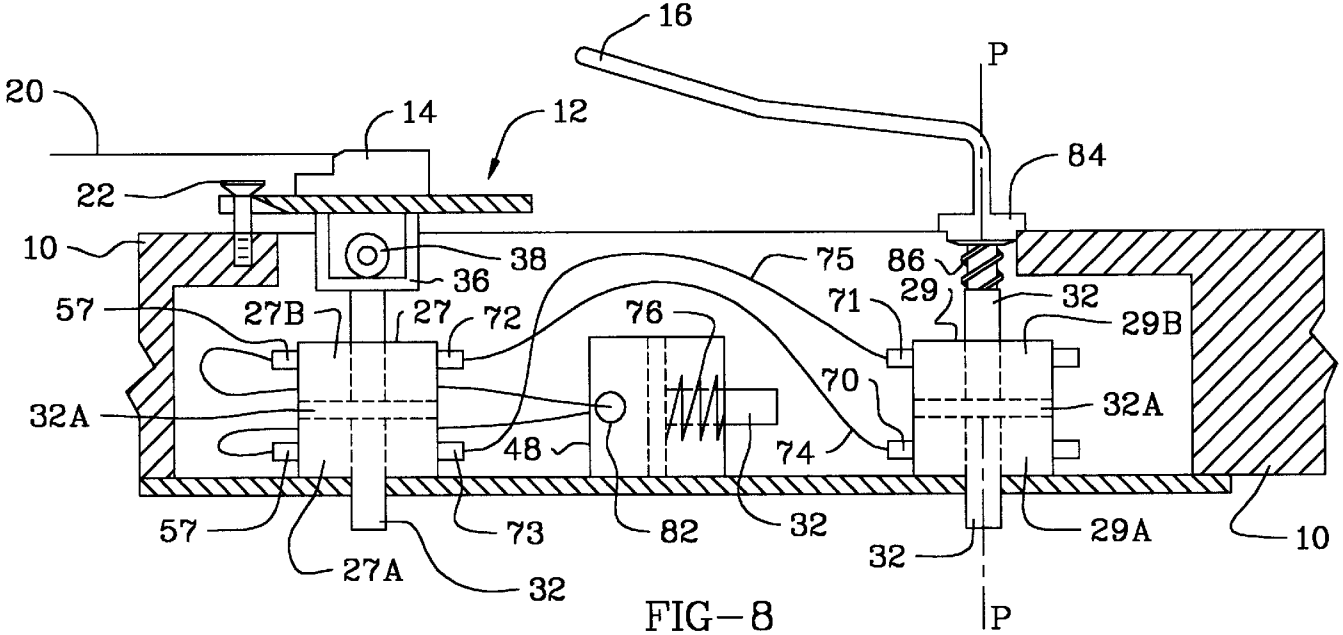
FIG. 8 is a side elevational view of a tremolo system according to a third preferred embodiment of the present invention, taken along line 3—3 of FIG. 1.
Figure 9:
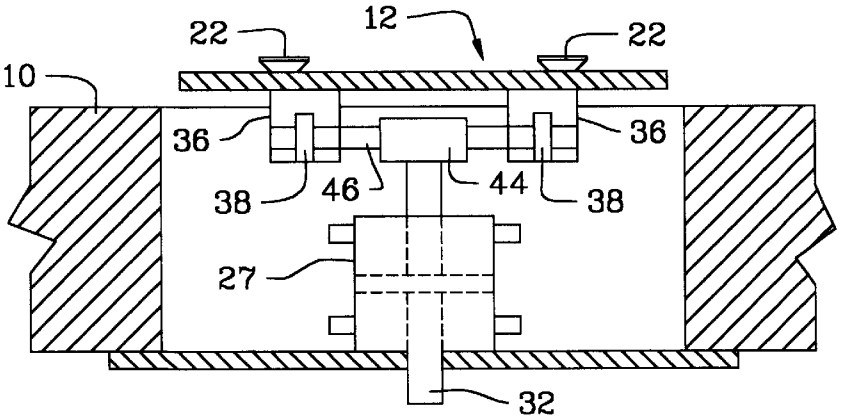
FIG. 9 is a side elevational view of the tremolo system according to a third preferred embodiment of the present invention, taken along line 2—2 of FIG. 1.

Referring to FIGS. 8 and 9, there is disclosed a tremolo system for a stringed musical instrument according to a third preferred embodiment of the present invention, comprising instrument body 10, instrument strings 20, instrument bridge 12, bridge connecting mechanism 36, 38, and 44, tremolo arm 16, first fluid member 29, second fluid member 27, third fluid member 48, and tremolo arm lead screw 86. The fluid members and their connecting mechanisms are preferably but not necessarily mounted within instrument body 10 relative to instrument bridge 12 and tremolo arm 16 so as to be substantially hidden from view and shielded from contact and/or tampering.

According to the preferred embodiments of the present invention, the user thereof is capable of generating a tremolo effect in part by rotating tremolo arm 16 about an axis substantially perpendicular to instrument body 10. As shown in FIG. 8, tremolo arm 16 preferably rotates about perpendicular axis P. In this way, the musician executes a more natural hand movement when generating a tremolo effect.

Instrument bridge 12 is engaged with the end portions of strings 20 so as to provide tension thereto. Bridge 12 preferably contacts pivot posts 22 (which are mounted to instrument body 10) so that bridge 12 rotates about posts 22, with the tension of strings 20 (and hence their pitch) being dependent upon the amount of rotation of bridge 12.

The present invention preferably but not necessarily includes a means for rotating bridge 12 relative to pivot posts 22 that is in proportion to the extent of rotation of tremolo arm 16 about axis P. The bridge rotating means preferably comprises a first fluid member 29 having piston rod 32 which is suitably connected to tremolo arm 16.

Referring to FIG. 8, first fluid member 29 preferably but not necessarily comprises a miniature hydraulic cylinder having non-compressible fluid therein and movable piston 32A which is connected to piston rod 32 and is slidably disposed within cylinder 29 so as to create two isolated chambers therein, each being filled with non-compressible fluid. In a preferred embodiment of the present invention, cylinder 29 is double acting, i.e., it includes ports 70 and 71 at either end thereof so that fluid is displaced by rod 32 and piston 32A moving in either direction.

The bridge rotating means preferably but not necessarily further includes second fluid member 27 (FIG. 8) having a piston rod 32 which is operably connected to bridge 12. Second fluid member 27 preferably but not necessarily comprises a miniature hydraulic cylinder having a non-compressible fluid therein and movable piston 32A which is connected to piston rod 32 and is slidably disposed within cylinder 27 so as to create two isolated chambers therein. In a preferred embodiment of the present invention, cylinder 27 is double acting, i.e., it includes ports 72 and 73 at either end thereof so that fluid is displaced by rod 32 and piston 32A moving in either direction.

In the third preferred embodiment of the present invention, fluid communication is provided between cylinder 27 and cylinder 29 so that fluid displaced in cylinder 29 due to rotation of tremolo arm 16 is applied to cylinder 27, thereby rotating bridge 12 about pivot posts 22. Referring to FIG. 8, tubing 74 connects port 70 of cylinder 29 with port 72 of cylinder 27 so as to provide fluid communication therebetween. Similarly, tubing 75 connects port 71 of cylinder 29 with port 73 of cylinder 27 so as to provide fluid communication therebetween. In this way, fluid that is displaced in one cylinder 27 or 29 due to movement of its piston rod 32 and piston 32A will urge fluid through tubing 74, 75 and into the other cylinder so as to impart motion to piston rod 32 of the other cylinder.

For example, as shown in FIG. 8, movement of rod 32 and piston 32A within cylinder 29 displaces fluid in one of chambers 29A or 29B whose volume is reduced thereby, depending on the direction of motion of rod 32. If piston rod 32 of cylinder 29 moves from top to bottom in FIG. 8, then fluid is displaced in chamber 29A of cylinder 29 so as to urge fluid through tubing 74 and into chamber 27B of cylinder 27. The increased volume of fluid in chamber 27B urges piston rod 32/piston 32A of cylinder 27 downwardly. This downward motion of piston rod 32 displaces fluid in chamber 27A of cylinder 27 so as to urge fluid therein into chamber 29B of cylinder 29 via tubing 75, thereby displacing the same amount of fluid on each side of cylinder pistons 32A when they are moved.

The present invention includes a means for connecting piston rod 32 of cylinder 29 to tremolo arm 16. Referring to FIG. 8, the connecting means preferably but not necessarily comprises a means for translating rotational movement of tremolo arm 16 into linear movement of piston rod 32, comprising lead screw 86.

Lead screw 86 is preferably but not necessarily mounted within instrument body 10 and is attached to an end portion of tremolo arm 16. Tremolo arm 16 and lead screw 86 threadingly engage with lead screw nut 84, which itself is fixed within and/or along a surface of instrument body 10 (FIG. 8). As a result, rotating tremolo arm 16 about axis P causes lead screw 86 to rotate which thereupon translates lead screw 86 in a linear or axial direction relative to instrument body 10.

In the third preferred embodiment of the present invention, lead screw 86 and lead screw nut 84 are preferably the anti-backlash type, wherein free axial movement therebetween is substantially eliminated. Lead screw 86 and lead screw nut 84 are preferably self-locking so that axial forces and/or thrusts exerted thereon will not create a torque on lead screw 86 relative to lead screw nut 84. In this way, axial forces exerted by piston rod 32 of cylinder 29 or by tremolo arm 16 will not cause lead screw 86 to rotate or axially move in any manner. Because of this feature and because cylinders 27 and 29 are filled with non-compressible fluid, bridge 12 remains substantially completely stable in a fixed position when tremolo arm 16 is at rest.

It is understood that components or assemblies other than lead screw 86 may be used to translate rotational motion of tremolo arm 16 to linear motion. For example, the present invention may utilize a cam member and cam follower assembly as disclosed in parent application Ser. No. 08/569,569 and described hereinabove with respect to the first preferred embodiment.

When tremolo arm 16 is at rest and strings 20 are substantially tuned, strings 20 pull bridge 12 upwardly. This upward force pulls piston rod 32 of cylinder 27 upwardly, which thereby urges piston rod 32 of cylinder 29 against lead screw 86. As a result, piston rod 32 of cylinder 29 substantially continuously contacts and applies pressure to lead screw 86 (FIG. 8) when the instrument is substantially tuned.

Additionally, the relationship between strings 20, bridge 12, cylinders 27 and 29, and lead screw 86 allows for the effective muting of the stringed instrument by placing one's hand against bridge 12. Because upward forces acting on bridge 12 due to strings 20 are substantially greater than the downward force acting on bridge 12 necessary to create a muting effect, the stringed instrument may be muted without altering string pitch.

Referring to FIG. 9, bridge 12 is connected to piston rod 32 of cylinder 27 by brackets 36, piston rod clevis 44, pin 46 and bearings/bushings 38. Brackets 36 are preferably connected to the underside of bridge 12 and include bearings/bushings 38 therein. Clevis 44 is connected to one end of piston rod 32 of cylinder 27. Pin 46 preferably extends through clevis 44 and bearings/bushings 38 of brackets 36 so that as piston 32A is raised or lowered within cylinder 27 due to rotational movement of tremolo arm 16, bridge 12 moves accordingly.

The tremolo system according to the present invention may preferably but not necessarily include a means for substantially automatically replenishing any minute amount of fluid within cylinders 27 and 29 which may have leaked therefrom over an extended period of time. As shown in FIG. 8, the replenishing means preferably comprises a third hydraulic cylinder 48 having piston rod 32, piston 32A and return spring 76; and check valve fittings 57 associated with cylinder 27.

Replenishing cylinder 48 is preferably but not necessarily single acting, thereby having non-compressible fluid and ports 82 disposed on only one side of piston 32A. Ports 82 of cylinder 48 are preferably directly connected to cavities 27A and 27B of cylinder 27 and are indirectly connected to cavities 29A and 29B of cylinder 29 via tubing 74 and 75. Spring 76 is disposed within cylinder 48 and engages with piston 32A of cylinder 48 so as to urge piston 32A towards ports 82, thereby creating fluid pressure therein. The resulting fluid pressure urges fluid into cylinders 27 and 29 via nylon tubing when the fluid pressure in cylinders 27 and 29 fall beneath the fluid pressure in cylinder 48, such as when the tension of strings 20 are substantially lowered.

Cylinder 27 preferably but not necessarily includes a pair of check valve fittings 57 (FIG. 8) which allow for the passage of fluid from cylinder 48 into cylinder 27 but prevent fluid flow in the reverse direction. In this way, pressure buildup in cylinders 27 and 29 will not affect cylinder 48, so that the operating pressure in cylinder 48 may be at a lower pressure than the operating pressures generated in cylinders 27 and 29.

It is understood that fluid members other than single and/or double acting cylinders may be used for cylinders 27 and 29. Further, cylinders 27 and 29 may comprise diaphragm-type cylinders in which negligible fluid leakage is eliminated, thereby eliminating the need for replenishing cylinder 48.

Cylinders 27 and 29 are preferably sized so that a musician may substantially effortlessly rotate bridge 12 by rotating tremolo arm 16. In addition, cylinders 27 and 29 (and hence their pistons) may be sized relative to each other so that the desired degree of rotation of bridge 12 about pivot posts 22 is achieved based upon rotation of tremolo arm 16.

In use, rotation of tremolo arm 16 in a first direction causes lead screw 86 to translate in a first axial direction along axis P. Such translation urges piston 32A of cylinder 29 to move (from top to bottom in FIG. 8) so as to create fluid displacement in chamber 29A of cylinder 29. The fluid displacement thereupon creates a comparable displacement in chamber 27B of cylinder 27, thereby moving piston 32A of cylinder 27 downwardly. This downward movement of piston 32A and piston rod 32 results in bridge 12 pivoting downwardly, thus increasing string pitch.

Similarly, rotation of tremolo arm 16 in a second rotational direction causes lead screw 86 to translate in a second axial direction along axis P (upwardly as shown in FIG. 8). This axial translation allows bridge 12 to pivot upwardly away from instrument body 10 due to forces applied to bridge 12 by strings 20 which are now capable of moving piston rod 32 of cylinder 27 upwardly and piston rod 32 of cylinder 29 more towards lead screw 86 (via fluid displacement from cylinder chamber 27B to 29A). As a result of bridge 12 being pivoted upwardly, string pitch is lowered relative to the string pitch when tremolo arm 16 is at rest.

Further, because the tension of strings 20 provide an upward force on bridge 12, a fluid displacement exists in cylinders 27 and 29 so as to urge piston rod 32 of cylinder 29 into contact with lead screw 86. When tremolo arm 16 is not being rotated, this contact substantially prevents any movement of cylinders 27 and 29, thereby ensuring that strings 20 can be independently tuned without the tuning of one string 20 from affecting the tuning of another.

The Fourth Preferred Embodiment

Figure 10:
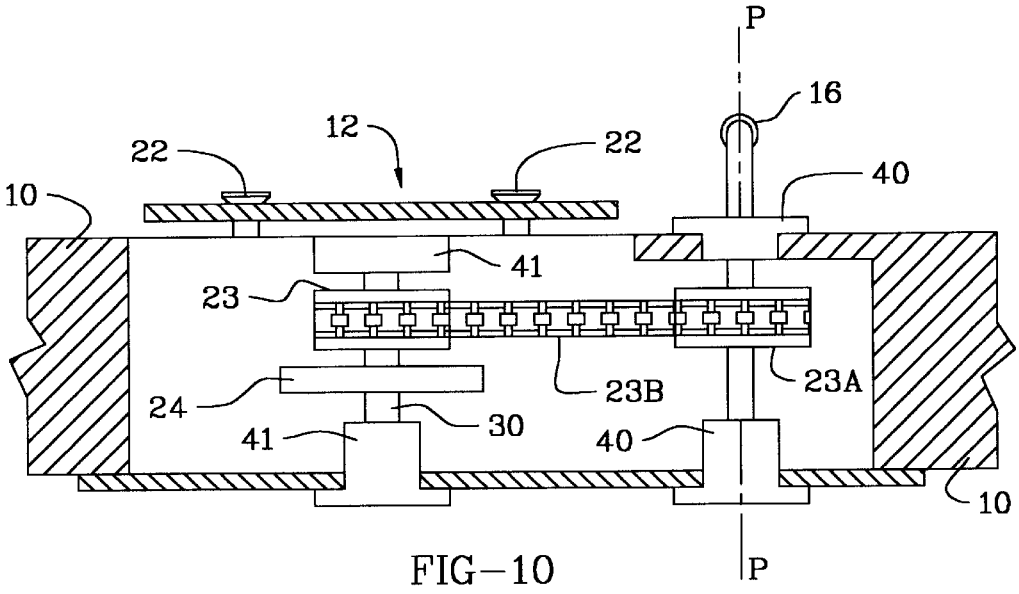
FIG. 10 is a side elevational view of a tremolo system according to a fourth preferred embodiment of the present invention, taken along line 2—2 of FIG. 1.
Figure 11:
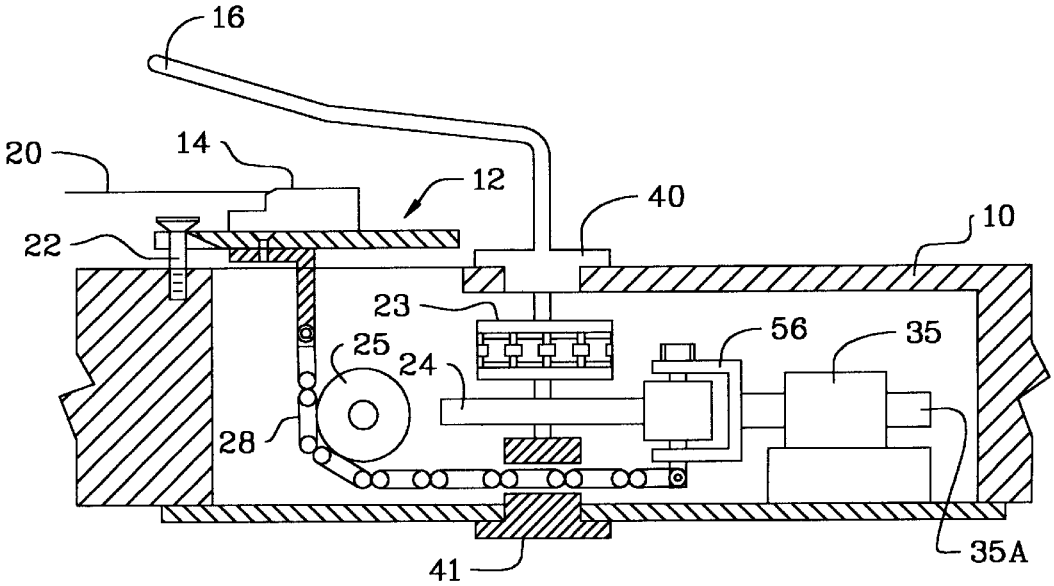
FIG. 11 is a side elevational view of the tremolo system according to a fourth preferred embodiment of the present invention, taken along line 3—3 of FIG. 1.

Referring to FIGS. 10 and 11, a fourth preferred embodiment of the present invention comprises tremolo arm 16; bridge 12, which pivots about pivot posts 22; and a means for rotating bridge 12 about pivot posts 22 in response to rotational movement of tremolo arm 16, thereby creating a tremolo effect. The bridge rotating means preferably includes sprockets 23, 23A and 25; drive chains 23B and 28; cam member 24; and cam follower 26.

According to the preferred embodiments of the present invention, the user thereof is capable of generating a tremolo effect in part by rotating tremolo arm 16 about an axis substantially perpendicular to instrument body 10. As shown in FIG. 10, tremolo arm 16 preferably rotates about perpendicular axis P. Tremolo arm 16 is mounted to instrument body 10 through bearings 40, which allow tremolo arm 16 to rotate. In this way, the musician executes a more natural hand movement when generating a tremolo effect.

Sprocket 23A is preferably attached along tremolo arm 16, as shown in FIG. 10. Shaft 30 is preferably mounted within instrument body 10 via bearings 41 so that shaft 30 is substantially parallel to the portion of tremolo arm 16 which is embedded within body 10. Sprocket 23, which is mounted along shaft 30, is engaged with sprocket 23A via drive chain 23B. As a result, rotating tremolo arm 16 rotates sprocket 23A which thereupon causes sprocket 23 and shaft 30 to rotate about their longitudinal axis.

As shown in FIGS. 10 and 11, the bridge rotating means preferably includes cam member 24 which is preferably attached along shaft 30, and cam follower 26 which is suspended substantially proximally to cam member 24 by clevis 56 and clevis shaft 35A. Cam member 24 is preferably but not necessarily divided into at least five sections, as explained above with respect to the second preferred embodiment of the present invention. Clevis 56 and clevis shaft 35A are selectively slidably attached along instrument body 10 by bushings 35. Drive chain 28 is preferably connected between bridge 12 and clevis 56 so that bridge 12 rotates about pivot posts 22 in response to movement of clevis shaft 35A along bushings 35. Sprocket 25 is preferably disposed between bridge 12 and clevis 56 in order to provide the necessary orientation for drive chain 28.

Drive chains 23B and 28 preferably but not necessarily provide substantially no backlash so that string pitch is tightly controlled.

In use, manually rotating tremolo arm 16 in a first direction causes sprocket 23A to rotate, which thereupon causes sprocket 23, shaft 30 and cam member 24 to rotate in a first direction so that cam portion 24A contacts cam follower 26. This contact moves cam follower 26, clevis 56 and clevis shaft 35A in an axial direction away from bridge 12 (from left to right in FIG. 11). The axial movement of clevis 56 pulls drive chain 28 so that bridge 12 is pulled downwardly towards instrument body 10, thereby increasing string pitch.

Manually rotating tremolo arm 16 in a second direction causes sprocket 23A to rotate, which causes sprocket 23, shaft 30 and cam member 24 to rotate in a second direction so that cam portion 24E is positioned adjacent cam follower 26. Because the radius of cam portion 24E is substantially less than the radii of the other cam portions, positioning cam portion 24E adjacent cam follower 26 allows bridge 12 to pivot upwardly away from instrument body 10 due to forces applied to bridge 12 by strings 20 which are now capable of pulling clevis 56 more towards cam member 24 and bridge 12 than if another portion of cam member 24 was adjacent cam follower 26. As a result of bridge 12 being pivoted upwardly, string pitch is lowered relative to string pitch when tremolo arm 16 is not rotated.

Further, because the tension of strings 20 provide an upward force on bridge 12, cam follower 26 is urged into contact with cam member 24. When tremolo arm 16 is not being rotated, this contact substantially prevents any movement of clevis 56, thereby ensuring that strings 20 can be independently tuned without the tuning of one of strings 20 from affecting the tuning of another.

It is noted that the fourth preferred embodiment of the present invention may be modified by eliminating shaft 30, sprockets 23 and 23A, and drive chain 23B (i.e., by connecting cam member 24 directly to tremolo arm 16).

The Fifth Preferred Embodiment

Figure 12:
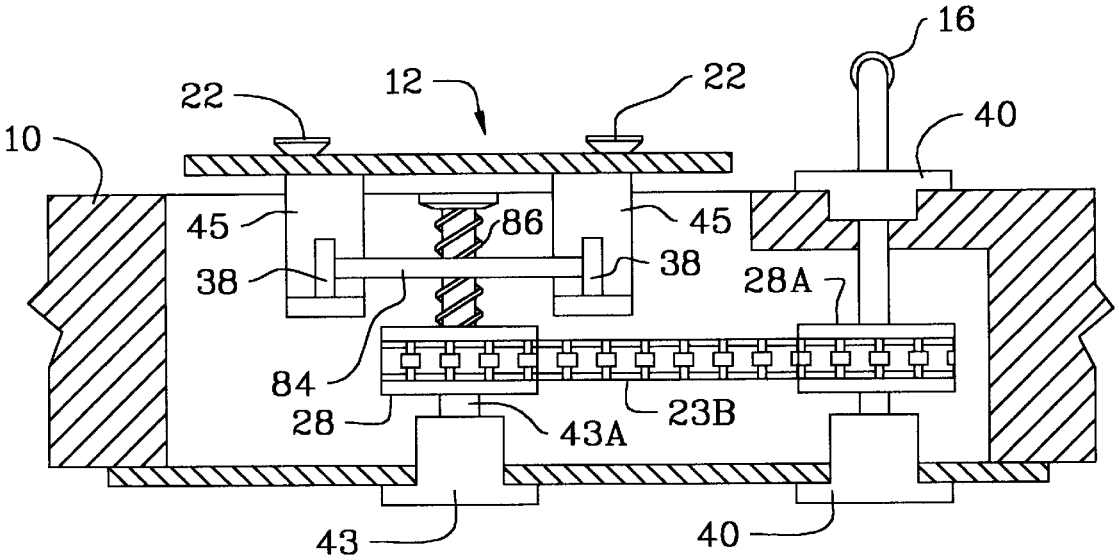
FIG. 12 is a side elevational view of the tremolo system according to a fifth preferred embodiment of the present invention, taken along line 2—2 of FIG. 1.
Figure 13:
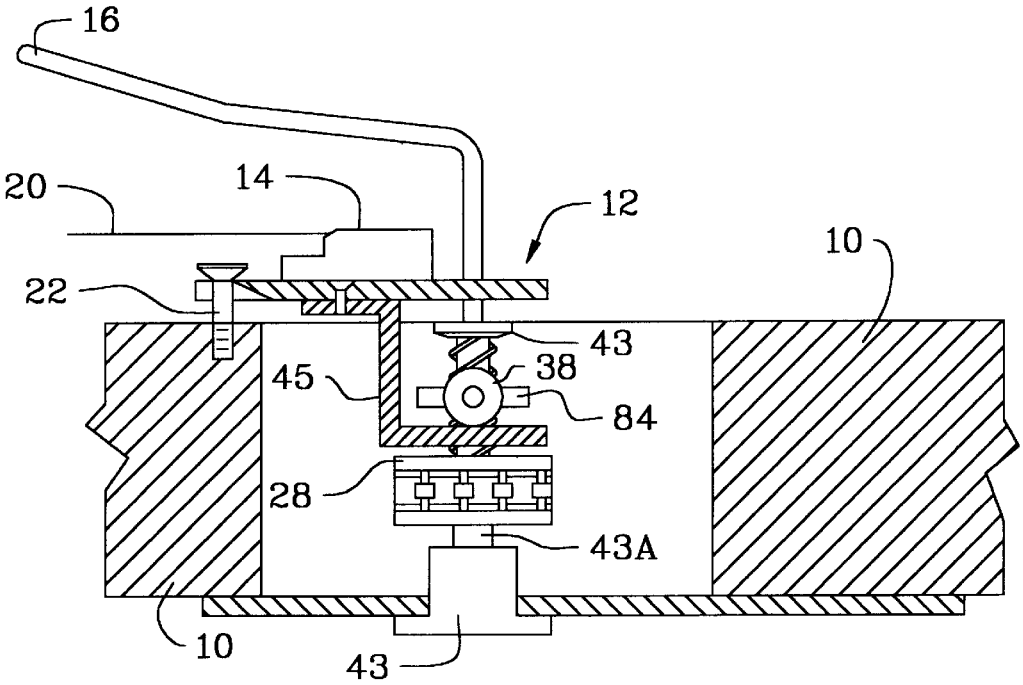
FIG. 13 is a side elevational view of the tremolo system according to a fifth preferred embodiment of the present invention, taken along line 3—3 of FIG. 1.

In a fifth preferred embodiment of the present invention, the bridge rotating means preferably but not necessarily includes sprocket 28A, which is attached to tremolo arm 16 between bearings 40; lead screw 86 having nut 84 and screw pins 43A; and sprocket 28, which is attached to lead screw 86, as shown in FIGS. 12 and 13.

Tremolo arm 16 is mounted partially within instrument body 10 using bearings 40 so that tremolo arm 16 may be selectively rotated along an axis P as explained above with respect to the fourth preferred embodiment. Referring to FIGS. 12 and 13, sprocket 28A is preferably connected to tremolo arm 16 between bearings 40. Lead screw 86 is preferably mounted within instrument body 10 substantially adjacent and in parallel to tremolo arm 16 by attaching screw pins 43A to mounted bearings 43 so that lead screw 86 may substantially freely rotate about its rotational axis. Sprocket 28 is preferably attached to lead screw 86 and positioned so that it is substantially planar relative to sprocket 28A. Drive chain 23B preferably operably connects to sprocket 28 to sprocket 28A so that rotation of sprocket 28A causes sprocket 28 to rotate.

Lead screw nut 84 of lead screw 86 is preferably substantially prevented from rotating within instrument body 10 so that it moves in an axial direction along lead screw 86 when lead screw 86 is rotated. Bridge bracket 45, which is attached to bridge 12 and extends downwardly therefrom (FIG. 13), is preferably but not necessarily slidingly engaged with lead screw nut 84 via bearings 38. This sliding engagement between bridge bracket 45 and bearings 38 allows bridge 12 to substantially freely pivot about pivot posts 22 in response to substantially axial movement of lead screw nut 84 along lead screw 86.

In the fifth preferred embodiment of the present invention, lead screw 86 and lead screw nut 84 are preferably the anti-backlash type, wherein free axial movement therebetween is substantially eliminated. Lead screw 86 and lead screw nut 84 are preferably self-locking so that axial forces and/or thrusts exerted thereon will not create a torque on lead screw 86 relative to lead screw nut 84. In this way, axial forces exerted by bridge 12 will not cause lead screw 86 to rotate or lead screw nut 84 to axially move in any manner. Because of this feature, bridge 12 remains substantially completely stable in a fixed position when tremolo arm 16 is at rest. This results in a tremolo system in which a change in tension of one string 20, which would otherwise affect the forces acting on bridge plate 12, is prevented from affecting the change in tension of the other strings 20 or of displacing tremolo arm 16.

In use, rotation of tremolo arm 16 in a first rotational direction causes sprocket 28A to rotate accordingly, which thereby causes sprocket 28 to rotate about its lateral axis in the first rotational direction. This rotating of sprocket 28 causes lead screw 86 to similarly rotate about its longitudinal axis, which thereupon causes lead screw nut 84 to move downwardly along lead screw 86. This downward movement of lead screw nut 84 results in bridge 12 pivoting downwardly, thus increasing string pitch.

Similarly, rotation of tremolo arm 16 in a second rotational direction causes sprocket 28A to rotate, which thereby causes sprocket 28 to rotate about its lateral axis in the second rotational direction. This rotating of sprocket 28 causes lead screw 86 to similarly rotate, which causes lead screw nut 84 to move upwardly along lead screw 86. Such upward movement allows bridge 12 to pivot upwardly away from instrument body 10 due to forces applied to bridge 12 by strings 20. As a result of bridge 12 being pivoted upwardly, string pitch is lowered.

It is noted that formulas for determining the efficiency and the self-locking characteristics of worm gearing, lead screws and spiral gears are known in the art, and such formulas may be used to ensure that lead screw 86 and lead screw nut 84 are designed for self-locking and/or efficient operation.

Although there have been described what are at present considered to be the preferred embodiments of the present invention, it will be understood that the invention can be embodied in other specific forms without departing from the spirit or essential characteristics thereof.

The described embodiments are, therefore, to be considered in all aspects as illustrative, and not restrictive. The scope of the invention is indicated by the appended claims rather than the foregoing descriptions.

I claim:

1. A vibrato device for a musical instrument having a body, a plurality of strings, a bridge which transmits vibrations from said strings to said body, and a tailpiece which supports one end of each of said strings, said vibrato device comprising:

a tremolo arm which is connected to the musical instrument; and means for engaging said tremolo arm with the instrument bridge so that movement of said tremolo arm causes movement of the instrument bridge;

wherein said engaging means comprises a cam member.

2. A vibrato device as recited in claim 1, wherein:

said engaging means comprises a cam follower connected to the instrument bridge, said cam follower being displaceable in response to movement of said cam member.

3. A vibrato device as recited in claim 2, further including:

a post member which extends from an underside of the instrument bridge and to which said cam follower is attached.

4. A vibrato device as recited in claim 2, wherein:

said cam follower includes a rotatable wheel member having an outer edge which engages with said cam member.

5. A vibrato device as recited in claim 1, wherein:

said cam member includes a first portion, a second portion and a third portion;

said first portion of said cam member has a greater radius than said second portion of said cam member; and said third portion of said cam member has a substantially constant radius, said third portion engaging with said contacting another component of when said tremolo arm is at rest.

6. A vibrato device as recited in claim 5, wherein:

an edge of said cam member between said first, said second and said third portions forms a modified sine curve.

7. A vibrato device as recited in claim 5, further including:

a means for biasing said third portion of said cam member into contact with another component said engaging means when said tremolo arm is at rest.

8. A device for generating a vibrato effect for a musical instrument having a body, a plurality of strings, a bridge which transmits vibrations from said strings to said body, and a tailpiece which supports one end of each of said strings, said device comprising:

a tremolo arm movably connected to the instrument and being pivotally movable about a first longitudinal axis;

a first rotatable member connected to the tremolo arm for movement thereby;

a second rotatable member, and which is operatively connected to the tailpiece, wherein at least one of said first and second rotatable members comprises a cam having an eccentric surface;

wherein rotation of said first rotatable member causes rotation of said second rotatable member further wherein said second rotatable member is operable to move the instrument bridge in response to rotation of said first rotatable member.

9. A tremolo device for a stringed musical instrument having a member which is engaged with each string, comprising:

an arm member movably connected to the instrument;

a first fluid means for moving the instrument member of the instrument so as to change a pitch of a tone generated by the instrument;

a means for connecting said arm member to said first fluid means such that movement of said arm member displaces fluid which moves the instrument member; and said arm member is movably engaged with said connecting means.

10. A device as recited in claim 9, wherein:

said connecting means comprises a lead screw.

11. A device as recited in claim 9, further including:

a second fluid means for translating fluid displacement in association with said first fluid means into movement of the instrument member.

12. A device as recited in claim 11, wherein:

said second fluid means comprises a second fluid cylinder in fluid communication with said first fluid cylinder and having a piston movable therein.

13. A device as recited in claim 12, wherein:

said second fluid means comprises a bracket member attached to the instrument member and a first member movably connected to said bracket member and connected to said piston of said second fluid cylinder.

14. A device as recited in claim 9, wherein:

said first fluid means comprises a first fluid cylinder having a piston movable therein.

15. A device for generating a vibrato effect in a stringed musical instrument which includes a bridge and a plurality of strings stretched across said bridge, said device comprising:

a movable member which is engaged with each of the strings, a tremolo arm movably connected to the instrument;

means, operatively connected between said tremolo arm and the instrument movable member, for adjusting tension of the instrument strings in accordance with movement by said tremolo arm; and wherein said tension adjusting means includes a blocking means comprising a cam and a cam follower for limiting movement of said movable member and thereby substantially minimizing an effect of a change in tension of one of the instrument strings on a tension in another of the instrument strings, said cam follower being displaceable in response to movement of said cam.

16. A device as recited in claim 15, wherein:

said tension adjusting means comprises a means for translating rotational movement of said tremolo arm into linear movement.

17. A device as recited in claim 16, wherein:

said movement translating means comprises a cam member attached to said tremolo arm and engaged with the instrument movable member.

18. A device as recited in claim 16, wherein:

said movement translating means comprises a lead screw connected between said tremolo arm and to the instrument movable member.

19. A device as recited in claim 15, wherein:

said tremolo arm is directly connected to a body of the instrument and indirectly connected to the instrument movable member.

20. A device as recited in claim 15, wherein:

said blocking means prevents movement of the instrument movable member and said tremolo arm due to changes in forces acting on the instrument movable member.

21. A vibrato device for a stringed musical instrument having a body member, a plurality of strings, a bridge member and a tailpiece which is integrally attached to and part of the bridge member so that the bridge member and tailpiece pivot about the same axis relative to the instrument body member, comprising:

a tremolo arm;

means, operatively connected between said tremolo arm and the bridge member, for modulating the bridge member and tailpiece relative to the body member in response to movement of said tremolo arm so as to substantially generate a vibrato effect; and wherein said modulating means comprises a means for translating rotational movement of said tremolo arm into movement of the bridge member, and further wherein said modulating means comprises a rotatable cam and a cam follower for substantially limiting movement of said bridge, so as to substantially minimize an effect of a change in tension of one of said strings on a tension of another of said strings.

22. A vibrato device as recited in claim 21, wherein said cam comprises a rotatable disk cam.

23. A vibrato device as recited in claim 21, wherein said cam follower is operatively connected to said movable member and engagable by said cam.

24. A vibrato device as recited in claim 21, wherein a portion of said cam comprises a modified sine curve.

25. A vibrato device as recited in claim 21, wherein a portion of said cam member comprises a substantially constant radius, and said substantially constant radius substantially limits movement of said bridge member when said tremolo arm is at rest, so as to substantially minimize an effect of a change in tension of one string on a tension of another of said strings.

26. A musical instrument, comprising:

a body;

a plurality of strings;

a tremolo arm pivotally mounted with respect to the body;

a bridge member which is operatively connected to the body and pivotally mounted with respect thereto, said bridge member comprising a movable bridge plate and a tailpiece fixedly attached to said bridge plate for concurrent movement therewith; and means for pivotally moving said bridge member in response to movement of said tremolo arm, comprising:

a first rotatable member connected to the tremolo arm for movement thereby;

a second rotatable member which is operatively connected to the bridge member, wherein at least one of said first and second rotatable members comprises a cam having an eccentric surface;

wherein rotation of said first rotatable member causes rotation of said second rotatable member, and further wherein said second rotatable member is operable to move the bridge member in response to rotation of said first rotatable member.

27. In a musical instrument of the type having a body, a plurality of strings, and a bridge member which transmits vibrations from said strings to said body, the improvement comprising:

said bridge member comprising a movable bridge plate and a tailpiece affixed thereto for concurrent movement therewith, one end of each of said strings being attached to said tailpiece, said bridge member further being pivotally mounted to said body for pivotal movement with respect thereto about an axis which is disposed outside of said body;

a tremolo arm which is pivotally mounted to said body; and an engaging mechanism interconnecting said tremolo arm and said bridge member, said mechanism being operable to pivotally move said bridge member about said axis in response to movement of said tremolo arm;

wherein said engaging mechanism comprises means for minimizing the effect of a change in tension in a first of said strings on another of said strings.

28. The vibrato device of claim 27, wherein said engaging mechanism comprises a cam which is operatively attached to said tremolo arm.

29. The vibrato device of claim 28, wherein said cam acts as a stop member to limit pivotal movement of said bridge member.

30. The vibrato device of claim 27, wherein the tremolo arm includes a segment disposed within said instrument body and having a longitudinal axis, and wherein tension on said strings may be adjusted by pivotal movement of said tremolo arm about the longitudinal axis of said tremolo arm segment.

31. The vibrato device of claim 30, further comprising a plurality of bearings in said instrument body, said segment of said tremolo arm being received by said bearings.

32. The vibrato device of claim 30, wherein said instrument body has a front face, and further wherein said longitudinal axis of said tremolo arm segment is parallel to the front face of said instrument body.

33. A vibrato device for a stringed musical instrument having a movable member engaged with at least one string, said vibrato device comprising an arm member connected to said instrument; and a first fluid means, operatively connected between said arm member and said movable member, for moving said movable member in response to movement of said arm member in a manner so as to change a pitch of a tone generated by said instrument.

34. In a musical instrument of the type having a body, a plurality of strings, and a bridge member which transmits vibrations from said strings to said body, the improvement comprising:

a tremolo arm which is pivotally attached to said musical instrument body;

a cam attached to a portion of said tremolo arm for concurrent pivotal movement therewith; and means for engaging said cam with said bridge member so that movement of said tremolo arm causes movement of said bridge member; and wherein said cam acts as a stop member to limit movement of said bridge member.

35. A vibrato device for a musical instrument having a body, a plurality of strings, a bridge member which transmits vibrations from said strings to said body, and a tailpiece which supports one end of each of said strings, wherein said tailpiece is affixed to said bridge member to form a bridge/tailpiece assembly which is pivotally movable with respect to said instrument body, said vibrato device comprising:

a tremolo arm which is rotatably connected to said instrument body, said tremolo arm comprising a segment having a longitudinal axis;

means, connected between said tremolo arm and said bridge member, for pivotally moving said bridge/tailpiece assembly about a bridge pivot axis in response to rotation of said tremolo arm about said longitudinal axis of said segment;

wherein said pivotally moving means tends to minimize the effect of a change in tension of one of said instrument strings on tension of another of said instrument strings when said tremolo arm is at rest;

and further wherein said bridge pivot axis is located spaced outwardly away from a surface of said body.

36. A vibrato device for a stringed musical instrument having a face and having a movable member engaged with at least one string, said vibrato device comprising:

a tremolo arm connected to the instrument, said tremolo arm having a segment with a longitudinal axis;

means, operatively connected between said tremolo arm and said movable member, for adjusting the tension of said at least one string in response to movement of said tremolo arm about said longitudinal axis of said tremolo arm segment.

37. A vibrato device for a stringed musical instrument having a face and having a movable member engaged with at least one string, said vibrato device comprising:

a tremolo arm connected to the instrument;

means, operatively connected between said tremolo arm and said movable member, for adjusting the tension of said at least one string in response to movement of said tremolo arm about an axis which is substantially parallel to said instrument face, said tension adjusting means comprising:

a first rotatable member operatively connected to said tremolo arm and extending downwardly therefrom; and a second rotatable member operatively connected to said movable member, wherein at least one of said first and second rotatable members comprises a cam having an eccentric surface.

38. A vibrato device for a musical instrument which includes a plurality of strings and a movable member engaged with said plurality of strings, said vibrato device comprising:

a tremolo arm;

a rotatable disk cam operatively engaged with said tremolo arm and said movable member such that movement of said rotatable disk cam, initiated by said tremolo arm, induces movement of said movable member to adjust tension on said strings and thereby to produce a vibrato effect, a cam follower which is operatively connected to said movable member and engagable by said disk cam, said cam follower comprising a rotatable wheel member having an outer edge engaged with said disk cam.

39. A vibrato device as recited in claim 38, wherein a portion of said rotatable disk cam comprises a substantially constant radius; wherein said substantially constant radius portion of said cam substantially limits movement of said movable member when said tremolo arm is at rest, so as to substantially minimize an effect of a change in tension of one string on a tension of another of said strings.

40. A vibrato device as recited in claim 38, wherein a portion of said rotatable disk cam comprises a modified sine curve.

* * * * *